US010172404B2

(12) United States Patent
Elharar

(10) Patent No.: US 10,172,404 B2
(45) Date of Patent: Jan. 8, 2019

(54) SKULL CAP

(71) Applicant: Shimon Shimshon Elharar, Jerusalem (IL)

(72) Inventor: Shimon Shimshon Elharar, Jerusalem (IL)

( * ) Notice: Subject to any disclaimer, the term of this patent is extended or adjusted under 35 U.S.C. 154(b) by 0 days.

(21) Appl. No.: 14/585,367

(22) Filed: Dec. 30, 2014

(65) Prior Publication Data

US 2015/0181969 A1 Jul. 2, 2015

(30) Foreign Application Priority Data

Dec. 31, 2013 (IL) ..... 230264

(51) Int. Cl.
*A42B 1/04* (2006.01)

(52) U.S. Cl.
CPC ..... *A42B 1/041* (2013.01)

(58) Field of Classification Search
CPC .. A41B 1/00; A41B 1/04; A41B 1/041; A41B 1/046; A41B 1/62
See application file for complete search history.

(56) References Cited

U.S. PATENT DOCUMENTS 1,369,971 A * 3/1921 Reynolds ..... 2/171.03
1,401,569 A * 12/1921 Semmig ..... 2/171.01
2,122,171 A * 6/1938 Alexander ..... 2/209.12
2,431,169 A * 11/1947 Dice ..... 40/329
2,730,722 A * 1/1956 Colangelo ..... 2/202
4,462,117 A * 7/1984 Brunelle ..... 2/202
4,873,726 A * 10/1989 Tapia ..... 2/195.1
5,070,545 A * 12/1991 Tapia ..... 40/329
5,099,524 A * 3/1992 Linday ..... 2/181
5,845,338 A * 12/1998 Clark ..... 2/195.1
6,018,821 A * 2/2000 Adams ..... 2/209.11
6,735,783 B2 * 5/2004 Phillips ..... 2/202
7,437,777 B2 * 10/2008 Marquardt ..... 2/202
2004/0034900 A1 * 2/2004 Gottlieb ..... 2/175.1
2006/0272073 A1 * 12/2006 Marquardt ..... 2/171
2007/0044203 A1 * 3/2007 Hall ..... 2/171
2007/0074326 A1 * 4/2007 Komechak ..... 2/12
2010/0186147 A1 * 7/2010 Garza ..... 2/209.12
2010/0299807 A1 * 12/2010 Saito ..... 2/174
2015/0335124 A1 * 11/2015 Passarello ..... A45D 8/36 132/275

* cited by examiner

*Primary Examiner* — Richale Quinn

(74) *Attorney, Agent, or Firm* — Michael J. Feigin, Esq.; Feigin & Fridman

(57) ABSTRACT

A skull cap includes one or more layers of material. The outermost surfaces of the skull cap includes a concave surface and a convex surface. The skull cap is delimited by a peripheral edge at which the concave and convex surfaces meet. The layer of the one or more layers which includes the concave surface is at least partially made of velvet.

6 Claims, 1 Drawing Sheet

SKULL CAP

FIELD OF THE INVENTION

The subject matter of the present application relates to skull caps, and in particular to a skull cap configured with a fastening arrangement.

BACKGROUND OF THE INVENTION

Skull caps are a traditional head covering worn in accordance with Jewish custom.

The shape of a skull cap can be considered to be a hollow semi-spherical shape. Stated differently, a skull cap has only two outermost or external surfaces, namely an internal concave surface and an external convex surface.

The skull cap is delimited at a peripheral edge at which the concave and convex surfaces meet. Stated differently, a skull cap is devoid of any construction outward from the peripheral edge. For example a skull cap is devoid of a rigid face shading projection comprised by baseball caps.

As the concave surface is hidden when worn, information such as the skull cap size and brand are typically printed on a tag attached to the concave surface or, alternatively, can be printed directly on the concave surface.

Different Jewish factions are known to wear skull caps identifiable to their faction. One faction (known to be called "modern orthodox") wears a so-called "knitted" skull cap type. Another faction (known to be called "ultra orthodox") wears a skull cap type comprising two layers of material joined or meeting along a peripheral edge, the outer convex layer of which is made of velvet and the inner layer of which is made of a material other than velvet.

The ultra orthodox faction, which wears the velvet outer layer skull cap, customarily do not use any visible fastening arrangement such as a rigid pin (e.g., a bobby pin) to fasten the skull cap to their head or, more precisely, to their hair (in contrast to the faction who wear the knitted type of skull cap and do use pins). Consequently, the velvet-outer layer skull caps are particularly prone to falling off a wearer's head, especially in windy conditions.

SUMMARY OF THE INVENTION

It has been found that a skull cap comprising an outermost concave surface at least partially made of velvet grips a wearer's hair in a surprisingly strong manner and thereby significantly reduces the tendency for the skull cap to fall or slide from a desired position on a wearer's head.

The inner velvet surface constituting a fastening arrangement.

Possible advantages of such design can be:

The fastening arrangement (which is associated with the concave surface) is not visible when worn (circumventing any custom against visible fastening mechanisms such as pins).

In the absence of a pin or other rigid element, the skull cap can be extremely comfortable to wear.

The fastening mechanism requires no operation (such as opening and closing or fastening, etc.).

While such fastening arrangement may not hold a skull cap to a wearer's head with a similar strength as a pin or set of pins, it is believed that at least one or more of the possible advantages listed above can render the design advantageous.

In accordance with a first aspect of the subject matter of the present application, there is provided a skull cap comprising a layer, the layer comprising an outermost concave surface of the skull cap and being made at least partially of velvet.

According to another aspect of the subject matter of the present application, there is provided a skull cap comprising one or more layers of material; the outermost surfaces of the skull cap being: a concave surface; and a convex surface; the skull cap being delimited by a peripheral edge at which the concave surface and the convex surface meet; and wherein a layer of the one or more layers which comprises the concave surface is at least partially made of velvet.

While velvet is a fabric which has been discovered to provide the advantages above, without being bound to theory, it is believed that the short fibers of the velvet which may provide the desired friction when contacting hair.

Accordingly, in accordance with yet another aspect of the subject matter of the present application, there is provided a skull cap comprising a layer, the layer comprising an outermost concave surface of the skull cap and being made at least partially of short fibers.

Short fibers are defined as being less than 10 mm long. It will be understood that the short fibers should also be configured to be wearable, i.e. they should be soft. Unlike the knitted skull caps, the short fibers are not knitted or woven.

It will be understood that the short fibers are velvet-like and are therefore dissimilar to Velcro®. In contradistinction to the subject matter of the present invention, Velcro® is made of hard and abrasive fibers which are not comfortable for wearing. Further Velcro® comprises two layers, one layer thereof being designed to hook into the other (i.e. non-straight fibers). Still further, Velcro® comprises of two connecting layers and hence is not known to be configured for connecting to hair.

It will be understood that the above-said is a summary, and that any of the aspects above may further comprise any of the features described hereinbelow. Specifically, the following features, either alone or in combination, may be applicable to any of the above aspects:

A. A skull cap can comprise an inner layer and an outer layer joined at a peripheral edge.

B. Both an inner layer and outer layer can be made of velvet or short fibers. Such construction can allow the skull cap to be reversible. Stated differently, a reversible skull cap can have identical outermost surfaces, such that when the skull cap is inverted or 'reversed' it has the same appearance as it had before it was inverted. For example both sides can have similar aesthetic lines.

C. Preferably, a majority of the layer comprising the concave surface can be made of velvet or short fibers. Even more preferably, the layer comprising the concave surface can be entirely made of velvet or short fibers. Most preferably the layer or layers comprising the outermost surfaces can be entirely made of velvet or short fibers. It is believed that increasing the amount of velvet or short fibers will provide increased friction against slippage.

D. The skull cap can be devoid of a rigid fastening arrangement or rigid element (e.g., a pin).

E. The fibers can be configured to project or extend transverse or, preferably perpendicular, to an inner surface of the inner layer. The fibers can be straight (i.e. not hooked).

F. The fibers can preferably have a length between 0.1 mm to 3 mm.

G. The short fibers can be soft (i.e. softer than Velcro®).

H. The peripheral edge can be round or, more particularly, can be circular.

I. The skull cap can be devoid of any construction beyond the peripheral edge.

J. The inner layer can be devoid of gaps of greater than 1 mm cross sectional area. Stated differently, a skull cap can be substantially air-tight, such that it causes a suction effect on a wearers head.

K. The skull cap can comprise only a single layer of material. The single layer can be made of velvet or short fibers.

BRIEF DESCRIPTION OF THE DRAWINGS

For a better understanding of the subject matter of the present application, and to show how the same may be carried out in practice, reference will now be made to the accompanying drawings, in which.

DETAILED DESCRIPTION

Figure 1:
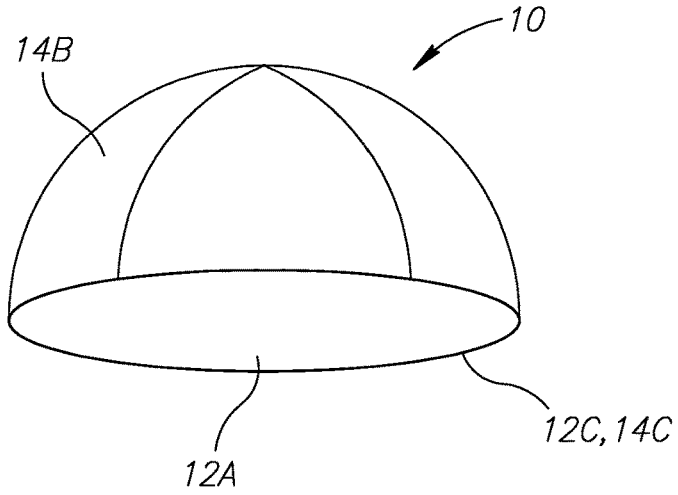
FIG. 1 is a skull cap in accordance with the subject matter of the present application.
Figure 2:
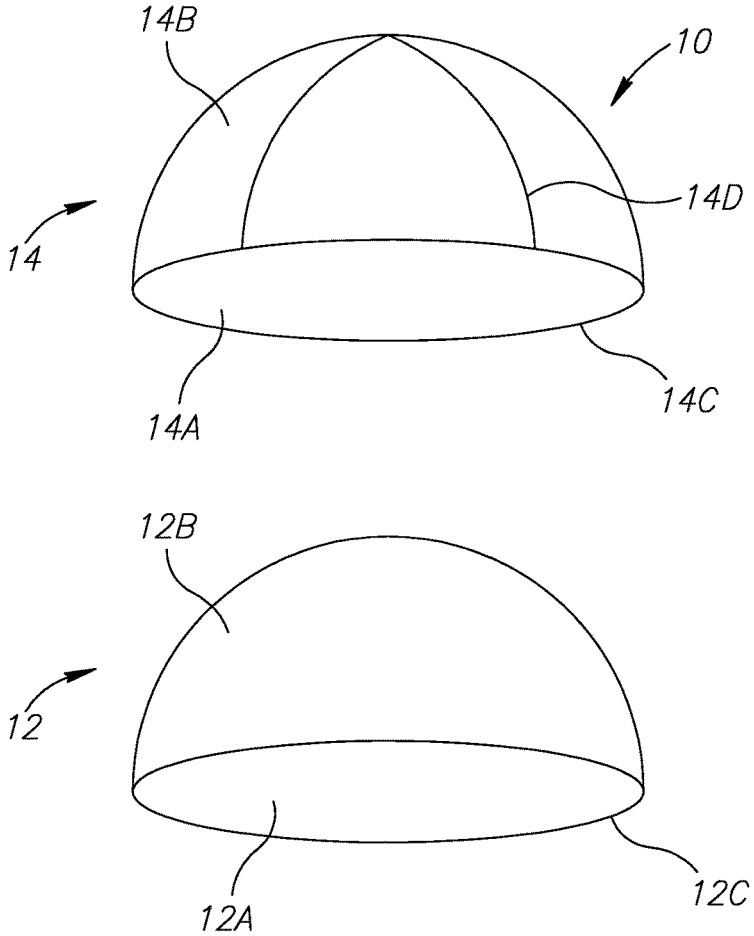
FIG. 2 is an exploded view of the skull cap in FIG. 1.

Reference is made to FIGS. 1 and 2 which illustrate an example skull cap 10.

The skull cap 10 can comprise an inner layer 12 and an outer layer 14.

Before being joined, the inner layer 12 is understood to comprise an inner concave surface 12A, an outer convex surface 12B, and a peripheral edge 12C at which the inner layer's concave surface 12A and convex surface 12B meet. The peripheral edge 12C can be circular.

Similarly, before being joined, the outer layer 14 is understood to comprise an inner concave surface 14A, an outer convex surface 14B, and a peripheral edge 14C at which the outer layer's concave surface 14A and convex surface 14B meet. The peripheral edge 14C can be circular.

As this example shows a skull cap 10 having more than one layer, it will be understood that the two layers are also joined at the peripheral edges 12C, 14C of the inner and outer layers 12, 14 and can consequently appear as illustrated in FIG. 1.

Notably, the inner layer's concave surface 12A and the outer layer's convex surface 14B constitute outermost surfaces of the skull cap 10 when assembled (FIG. 1).

The outermost concave surface 12A is made at least partially of velvet or a material having similar properties, particularly a material with short fibers. In the present non-limiting example the inner layer 12 is made entirely of velvet.

A wearer (not shown) can wear the skull cap 10, and the velvet associated with the inner layer 12, or more specifically with the inner concave surface 12A thereof, which contacts the wearer's head, can provide a desired anti-slip or fastening effect when contacting hair of the wearer.

In the present non-limiting example, the outer layer 14 can preferably also be made entirely of velvet.

While the embodiment shown has two layers, alternatively, a skull cap itself could be comprised only of a single layer similarly comprising an concave surface at least partially, and preferably entirely, made of velvet.

In the two-layer embodiment shown, there are aesthetic lines 14D, which are typically stich lines, formed on the outer convex surface 14B. The aesthetic lines 14D can extend from the peripheral edge 12C, 14C to a center of the skull cap. It will be understood that in a single layer embodiment the aesthetic lines 14D can be on the single layer.

The description above includes an exemplary embodiment and details, and does not exclude non-exemplified embodiments and details from the claim scope of the present application.

The invention claimed is:

1. A skull cap consisting of:

a first layer of material made of velvet comprising a peripheral edge;

a second layer of material made of velvet and comprising a peripheral edge;

the skull cap having an outer convex surface and an inner concave surface;

the first and second layers of material being joined at the respective peripheral edges thereof such that the first layer of velvet material comprises the concave surface of the skull cap and the second layer of velvet material comprises the convex surface of the skull cap;

the skull cap being delimited by a peripheral edge at which the concave surface and the convex surface meet;

wherein the skull cap is devoid of any rigid element; and wherein the peripheral edge is circular.

2. The skull cap according to claim 1, wherein both the concave surface and the convex surface are identical.

3. The skull cap according to claim 1, wherein only the convex surface comprises aesthetic lines extending from the peripheral edge to a center of the skull cap.

4. The skull cap according to claim 1, wherein both the convex surface and the concave surface comprise aesthetic lines extending from the peripheral edge to a center of the skull cap.

5. The skull cap according to claim 4, wherein both the convex surface and the concave surface comprise the same number of aesthetic lines.

6. The skull cap according to claim 1, wherein the concave surface and/or convex surface is devoid of gaps of greater than 1 mm cross sectional area.

* * * * *